US011779060B2

(12) United States Patent
Callahan

(10) Patent No.: US 11,779,060 B2
(45) Date of Patent: Oct. 10, 2023

(54) HIDDEN CONTROL WAISTBAND GARMENT

(71) Applicant: Lysse Partners LLC, Indianapolis, IN (US)

(72) Inventor: Nicole Callahan, New York, NY (US)

(73) Assignee: LYSSE PARTNERS LLC, Indianapolis, IN (US)

( * ) Notice: Subject to any disclaimer, the term of this patent is extended or adjusted under 35 U.S.C. 154(b) by 0 days.

(21) Appl. No.: 17/471,746

(22) Filed: Sep. 10, 2021

(65) Prior Publication Data

US 2021/0401068 A1 Dec. 30, 2021

Related U.S. Application Data

(63) Continuation of application No. 16/001,512, filed on Jun. 6, 2018, now abandoned, which is a continuation (Continued)

(51) Int. Cl.
*A41C 1/08* (2006.01)
*A41D 27/02* (2006.01)

(Continued)

(52) U.S. Cl.
CPC ..... *A41C 1/08* (2013.01); *A41D 1/06* (2013.01); *A41D 1/14* (2013.01); *A41D 27/02* (2013.01); *A41D 31/02* (2013.01); *A41B 2400/38* (2013.01); *A41C 1/02* (2013.01); *A41D 1/22* (2013.01); *A41D 2400/38* (2013.01)

(58) Field of Classification Search
CPC ..... A42B 9/10; A41H 3/02; A41D 15/005
See application file for complete search history.

(56) References Cited

U.S. PATENT DOCUMENTS 1,249,446 A 12/1917 Mell
2,035,377 A 3/1936 Redmond (Continued)

FOREIGN PATENT DOCUMENTS

AT 411743 11/2008
AU 4992401 10/2001

(Continued)

OTHER PUBLICATIONS

International Search Report issued in International Application No. PCT/US2014/072952 dated Feb. 17, 2015, Previously provided in U.S. Appl. No. 14/575,481.

(Continued)

*Primary Examiner* — Gloria M Hale
(74) *Attorney, Agent, or Firm* — Arnold & Porter Kaye Scholer LLP

(57) ABSTRACT

A lower body garment with shaping benefits is provided. The lower body garment may comprise an outer garment and a control panel inside the outer garment, such that the control panel is not visible from the outside of the outer garment. The control panel may have a rectangular shape and line a full circumference of an interior waist of the outer garment. Further, the control panel may be anchored to the outer garment at a top edge seam of the outer garment. In certain aspects, the lower body garment may be a legging, pant or skirt.

17 Claims, 10 Drawing Sheets

Related U.S. Application Data of application No. 14/575,481, filed on Dec. 18, 2014, now Pat. No. 9,993,034.

(60) Provisional application No. 61/923,322, filed on Jan. 3, 2014.

(51) Int. Cl.

| | |
|---|---|
| ***A41D 1/06*** | (2006.01) |
| ***A41D 1/14*** | (2006.01) |
| ***A41D 31/02*** | (2019.01) |
| *A41D 1/22* | (2018.01) |
| *A41C 1/02* | (2006.01) |

(56) References Cited

U.S. PATENT DOCUMENTS

| | | | |
|---|---|---|---|
| 2,548,143 | A | 4/1951 | Christiansen |
| 2,580,774 | A | 1/1952 | Helbig |
| D168,957 | S | 3/1953 | Maisch |
| 2,701,363 | A | 2/1955 | Roodner |
| 3,080,868 | A | 3/1963 | Zanca |
| 3,130,730 | A | 4/1964 | Zanca |
| 3,161,931 | A | 12/1964 | Zif |
| 3,228,401 | A | 1/1966 | Byrne |
| 3,234,947 | A | 2/1966 | Bergstein |
| 3,246,342 | A | 4/1966 | Pagano |
| 3,362,409 | A | 1/1968 | Bruno |
| RE26,360 | E | 3/1968 | Pagano |
| 3,378,013 | A | 4/1968 | Bruno |
| 3,406,434 | A | 10/1968 | Moskowitz |
| 3,406,692 | A | 10/1968 | Pernas |
| 3,414,907 | A | 12/1968 | Flame |
| 3,463,369 | A | 8/1969 | Moskowitz |
| 3,467,107 | A | 9/1969 | Heyman et al. |
| 3,525,341 | A | 8/1970 | Guberman |
| 3,663,963 | A | 5/1972 | Miller |
| 3,677,252 | A | 7/1972 | Pedley |
| 3,707,973 | A | 1/1973 | Welsch et al. |
| 3,717,154 | A | 2/1973 | Spetalnik |
| 3,751,731 | A | 8/1973 | Bennett |
| 3,848,268 | A | 11/1974 | D'Ambrosio |
| 3,869,728 | A | 3/1975 | Spencer |
| 4,012,550 | A | 3/1977 | Hollander |
| 4,241,460 | A | 12/1980 | Tolbert |
| D259,451 | S | 6/1981 | Vale |
| D275,907 | S | 10/1984 | Locascio |
| D275,999 | S | 10/1984 | Martini |
| D276,000 | S | 10/1984 | Locascio |
| D276,001 | S | 10/1984 | Locascio |
| 4,549,317 | A | 10/1985 | D'Ambrosio |
| D281,924 | S | 12/1985 | Martini |
| D284,037 | S | 6/1986 | DiTullio |
| 4,890,337 | A | 1/1990 | Greenberg |
| 5,168,581 | A | 12/1992 | Garcia et al. |
| 5,566,393 | A | 10/1996 | Best |
| 5,762,535 | A | 6/1998 | Nishiyama et al. |
| 5,771,494 | A | 6/1998 | Ralston et al. |
| 5,888,118 | A | 3/1999 | Kishi |
| 5,978,971 | A | 11/1999 | Wald |
| 6,035,448 | A | 3/2000 | Thomson |
| 6,041,442 | A | 3/2000 | Owen |
| 6,276,176 | B1 | 8/2001 | Blakely |
| 6,311,333 | B1 | 11/2001 | Batra |
| 6,367,086 | B1 | 4/2002 | Woodard |
| 6,430,748 | B1 | 8/2002 | Burkhart |
| 6,543,062 | B1 | 4/2003 | Amsel |
| 7,048,013 | B2 | 5/2006 | Shannon |
| 7,115,015 | B2 | 10/2006 | Horii et al. |
| 7,159,621 | B2 | 1/2007 | Shannon |
| 7,311,197 | B1 | 12/2007 | Wilkinson et al. |
| 7,341,500 | B2 | 3/2008 | Horn et al. |
| 7,418,742 | B2 | 9/2008 | Yoo |
| 7,452,179 | B2 | 11/2008 | Boriani et al. |
| 7,452,260 | B2 | 11/2008 | Redenius |
| 7,549,302 | B2 | 6/2009 | Duckham et al. |
| D606,285 | S | 12/2009 | Schindler |
| 7,645,179 | B2 | 1/2010 | Redenius |
| 7,654,115 | B2 | 2/2010 | Duckham et al. |
| D616,627 | S | 6/2010 | Schindler |
| D622,477 | S | 8/2010 | Schindler |
| RE41,654 | E | 9/2010 | Struble |
| D623,377 | S | 9/2010 | Schindler |
| D627,134 | S | 11/2010 | Rhodes |
| 7,849,518 | B2 | 12/2010 | Moore et al. |
| 7,853,492 | B1 | 12/2010 | Kirklin et al. |
| 7,867,056 | B2 | 1/2011 | Scheininger et al. |
| 7,867,057 | B2 | 1/2011 | Scheininger et al. |
| D632,015 | S | 2/2011 | Lai |
| D632,051 | S | 2/2011 | Schindler |
| D632,052 | S | 2/2011 | Schindler |
| D632,053 | S | 2/2011 | Schindler |
| 7,878,030 | B2 | 2/2011 | Burr |
| 7,905,117 | B2 | 3/2011 | Kronback |
| D641,128 | S | 7/2011 | Zarabi |
| D641,130 | S | 7/2011 | Zarabi |
| 8,122,520 | B2 | 2/2012 | Wilson |
| 8,123,590 | B2 | 2/2012 | MacKinnon |
| D656,298 | S | 3/2012 | Schindler |
| 8,167,678 | B2 | 5/2012 | Castellano |
| 8,185,970 | B2 | 5/2012 | Summers et al. |
| D665,558 | S | 8/2012 | Schindler |
| 8,235,765 | B2 | 8/2012 | Falla |
| 8,235,766 | B2 | 8/2012 | Melarti et al. |
| D666,384 | S | 9/2012 | Schindler |
| D667,607 | S | 9/2012 | Schindler |
| 8,262,433 | B2 | 9/2012 | Castellano |
| D673,756 | S | 1/2013 | Agnew et al. |
| 8,402,567 | B2 | 3/2013 | Agassi et al. |
| 8,418,268 | B2 | 4/2013 | Waldman |
| 8,568,195 | B1 | 10/2013 | Schindler |
| 8,827,764 | B2 | 9/2014 | Caruso et al. |
| 8,959,665 | B1 | 2/2015 | Garner et al. |
| 9,993,034 | B2 * | 6/2018 | Callahan ..... A41D 1/06 |
| 2002/0092084 | A1 | 7/2002 | Takayama |
| 2004/0137821 | A1 | 7/2004 | Sandroussi et al. |
| 2004/0237173 | A1 | 12/2004 | Villalobos |
| 2005/0020184 | A1 | 1/2005 | Izcoa |
| 2005/0132474 | A1 | 6/2005 | Amsel |
| 2005/0236106 | A1 | 10/2005 | Sanfiorenzo |
| 2006/0048547 | A1 | 3/2006 | Duckham et al. |
| 2006/0174963 | A1 | 8/2006 | Shannon |
| 2007/0026767 | A1 | 2/2007 | Scheininger et al. |
| 2007/0199134 | A1 | 8/2007 | Duckham et al. |
| 2007/0256208 | A1 | 11/2007 | Yoo |
| 2008/0034476 | A1 | 2/2008 | MacKinnon |
| 2008/0078012 | A1 | 4/2008 | Mario |
| 2008/0229474 | A1 | 9/2008 | Fons et al. |
| 2008/0244805 | A1 | 10/2008 | Griffin |
| 2008/0256676 | A1 | 10/2008 | Di Lorenzo |
| 2008/0261490 | A1 | 10/2008 | Scheininger et al. |
| 2008/0271226 | A1 | 11/2008 | Erana Ahumada |
| 2009/0031469 | A1 | 2/2009 | Spivis et al. |
| 2009/0068908 | A1 | 3/2009 | Hinchcliff |
| 2010/0037368 | A1 | 2/2010 | Steams |
| 2010/0041313 | A1 | 2/2010 | Castellano |
| 2010/0136882 | A1 | 6/2010 | Malish |
| 2010/0167626 | A1 | 7/2010 | Hamlet |
| 2010/0192274 | A1 | 8/2010 | Karasina |
| 2010/0192283 | A1 | 8/2010 | Kim |
| 2010/0192284 | A1 | 8/2010 | Simon |
| 2010/0273395 | A1 | 10/2010 | Castellano |
| 2010/0275339 | A1 | 11/2010 | Hue |
| 2011/0003533 | A1 | 1/2011 | Caruso et al. |
| 2011/0099677 | A1 | 5/2011 | Mamiye et al. |
| 2011/0131705 | A1 | 6/2011 | Waldman et al. |
| 2011/0179556 | A1 | 7/2011 | Partovi |
| 2011/0209262 | A1 | 9/2011 | Waldman et al. |
| 2011/0214216 | A1 | 9/2011 | Zarabi |
| 2011/0225696 | A1 | 9/2011 | Di Lorenzo |
| 2012/0000007 | A1 | 1/2012 | Hansen |
| 2012/0060253 | A1 | 3/2012 | Bergin (nee Madonna) et al. |
| 2012/0129425 | A1 | 5/2012 | Bevans |
| 2012/0149277 | A1 | 6/2012 | Moses-Jones et al. |

(56) References Cited

U.S. PATENT DOCUMENTS

| | | | |
|---|---|---|---|
| 2012/0266347 | A1 | 10/2012 | Lorenzo |
| 2013/0095730 | A1 | 4/2013 | Jensen |
| 2013/0145516 | A1 | 6/2013 | Zielinski |
| 2013/0239294 | A1 | 9/2013 | Clement |
| 2013/0298306 | A1 | 11/2013 | Turner |
| 2013/0312157 | A1 | 11/2013 | Freddi et al. |
| 2014/0141692 | A1 | 5/2014 | Yuasa et al. |
| 2014/0273734 | A1 | 9/2014 | Gordon |
| 2015/0189921 | A1 | 7/2015 | Callahan |

FOREIGN PATENT DOCUMENTS

| | | |
|---|---|---|
| CA | 2518578 | 8/2006 |
| CA | 2698291 | 3/2009 |
| CA | 2690478 | 10/2010 |
| CN | 1174685 A | 3/1998 |
| CN | 101647602 | 2/2010 |
| CN | 101827969 | 9/2010 |
| CN | 101869358 | 10/2010 |
| DE | 602004017309 | 12/2008 |
| DE | 102009015043 | 2/2010 |
| EP | 1643872 | 4/2006 |
| EP | 1740374 | 1/2007 |
| EP | 2188423 | 5/2010 |
| EP | 2245949 | 11/2010 |
| FR | 2934945 | 2/2010 |
| GB | 2356552 | 5/2001 |
| GB | 2423234 | 8/2006 |
| GB | 2462500 | 6/2011 |
| JP | 2010043399 | 2/2010 |
| MX | 2010002835 | 4/2010 |
| MX | 2010004605 | 10/2010 |
| TW | 200932972 | 8/2009 |
| WO | WO 2001/076398 | 10/2001 |
| WO | WO 2005/006894 | 1/2005 |
| WO | WO 2005/103179 | 11/2005 |
| WO | WO 2007/016404 | 2/2007 |
| WO | WO 2009/036155 | 3/2009 |
| WO | WO 2011/137311 | 11/2011 |
| WO | WO 2012/082550 | 6/2012 |
| WO | WO 2012/082896 | 6/2012 |

OTHER PUBLICATIONS

International Search Report and Written Opinion issued in International Application No. PCT/US2014/071130 dated Mar. 5, 2015, Previously provided in U.S. Appl. No. 14/575,481.

* cited by examiner

SAME BOTH
SIDES

HIDDEN CONTROL WAISTBAND GARMENT

RELATED APPLICATIONS

This application is a continuation of U.S. application Ser. No. 16/001,512, filed Jun. 6, 2018, (now abandoned) which is continuation of U.S. application Ser. No. 14/575,481, filed Dec. 18, 2014 (now U.S. Pat. No. 9,993,034, issued Jun. 12, 2018), which claims priority to U.S. Provisional Application No. 61/923,322, filed Jan. 3, 2014, entitled "HIDDEN CONTROL WAISTBAND GARMENT," the content of each of which is incorporated herein by reference in their entireties.

FIELD OF THE INVENTION

The present invention relates to the field of garments, and more particularly, to lower body garments that provide shaping benefits.

BACKGROUND OF THE INVENTION

Garments have been providing wearers functional and aesthetic utilities throughout human history. In recent years, shaping underwear (such as corsets, bras, and girdles) has gained popularity among women because it helps a wearer to achieve a more fashionable figure. In many cases, however, the wearer must also wear a fashionable outer garment, not only to conceal the shaping underwear, but also to fully take advantage of the underwear's shaping properties. There is a need in the art for a garment that combines the outward appearance of a conventional garment with the shaping benefits of traditional shaping underwear.

BRIEF SUMMARY OF THE INVENTION

The present disclosure is best understood with reference to the claims, the entire specification, and the drawings submitted herewith, which describe the embodiments according to the present disclosure in greater detail. The summary is merely intended to convey aspects of illustrative embodiments.

The present disclosure describes embodiments of a lower body garment that provides shaping benefits. An exemplary garment according to the present disclosure may comprise an outer garment, and a control panel inside the outer garment and anchored to the outer garment at a top edge seam of the outer garment. The outer garment may be high-waisted so that the top edge seam may be at a wearer's natural waist.

In certain aspects, the exemplary garment may be a legging or pant, and the control panel may have a horizontal rectangular shape that lines the outer garment at both front and back. In some embodiments, the bottom of the control panel may be floating. Further, in some other embodiments, the control panel may be anchored along one or more vertical seams such as side seams (e.g., inside, outside), rise seams (e.g., front, back), etc. The outer garment may be made of a fabric that conceals the control panel. In at least one embodiment, the control panel may comprise two layers of fabric and cover the full circumference of an interior waist of the outer garment. In one embodiment, the two layers of fabric of the control panel may be bound together at the bottom edge of the fabric, but not sewn or glued to the outer garment itself.

In other aspects, the exemplary garment may be a skirt with the outer garment being an outer skirt and the control panel may be part of an interior lining of the skirt. The interior lining may extend from the top edge seam of the outer garment to the outer skirt hem or to just above the outer skirt hem, and may comprise a first and second area. The control panel may be the first area of the interior lining. In some other embodiments, the control panel may be anchored along one or more vertical seams such as side seams (e.g., inside, outside), center back seams, or any design seams (e.g., vertical stylish seams). The outer skirt may be made of a fabric that conceals the control panel. In at least one embodiment, the control panel may comprise two layers of fabric and cover the full circumference of an interior waist of the outer skirt. In one embodiment, the two layers of fabric of the control panel may be bound together at the bottom edge of the fabric and the second area of the interior lining may be a single layer of lining fabric attached to the bottom edge of the control panel. The second area of the interior lining may provide light control to the thigh and butt, and extends to the hem of the outer garment or to just above the hem of the outer garment.

In yet other aspects, an exemplary garment according to the present disclosure may comprise an outer garment, and a first and second interior areas to provide control. The outer garment may be a legging or pant, and may have a top edge seam and lower waist seam. In some embodiments, the outer garment may be high-waisted so that the top edge seam may be at a wearer's natural waist. The first interior area may have a horizontal rectangular shape that lines the outer garment between the top edge seam and lower waist seam, and may cover the full circumference of an interior waist of the outer garment. Moreover, the first interior area may comprise one or two layers of lining fabric. In at least one embodiment, the first interior area may be anchored to the outer garment at the top edge seam. In some embodiments, the bottom of the first interior area may be floating. However, in some other embodiments, the bottom of the first interior area may be anchored to the outer garment at the lower waist seam. The outer garment may be made of a fabric that conceals the first and second interior areas. In one embodiment, the first interior area may comprise two layers of fabric. In another embodiment, the two layers of fabric of the control panel may be bound together at the bottom edge of the fabric. The second interior area may be a lining that begins at the lower waist seam and extends down around the hip, thigh and butt area. In some other embodiments, the second interior area may be attached either by sewing into the seams of the garment or by bonding or gluing to the interior face of the outer garment fabric, or by a combination of these attaching methods.

BRIEF DESCRIPTION OF THE DRAWINGS

In the accompanying drawings that form a part of the specification and are to be read in conjunction therewith, the present invention is illustrated by way of example and not limitation, with like reference numerals referring to like elements, wherein.

DETAILED DESCRIPTION

Figures 1A, 1B:
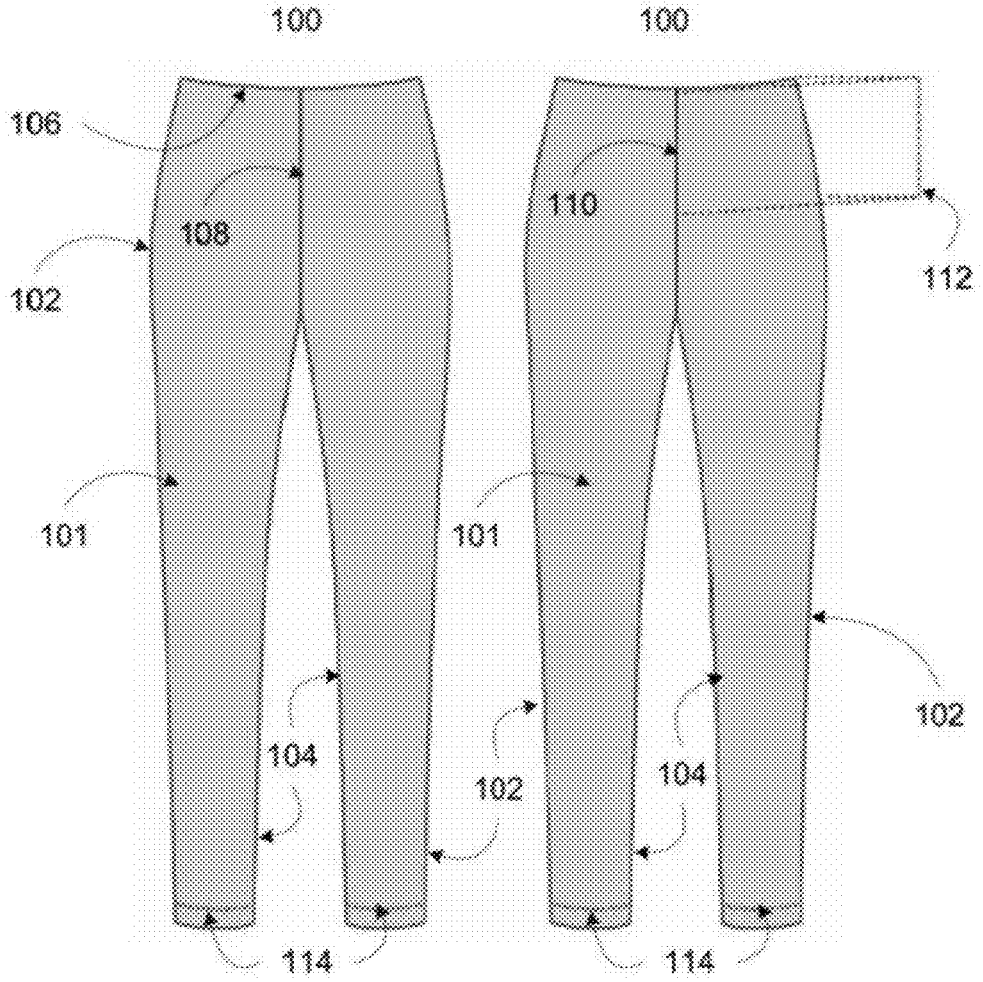
FIGS. 1A and 1B show the front and back of an exemplary garment according to the present disclosure.

In the following detailed description, numerous specific details are set forth in order to provide a thorough understanding of embodiments of the disclosure. In other instances, well-known constructions of garments have not been shown in detail, as they are understood by those of skill in the art. It is intended that no part of this specification be construed to effect a disavowal of any part of the full scope of the disclosure.

The present disclosure describes garments that provide shaping benefits. In one exemplary embodiment according to the present disclosure, as shown on FIGS. 1A and 1B, a lower body garment 100 may comprise side seams, such as the outside seams 102 and inside seams 104, and center front seam 108 and center back seam 110. At the top, the lower body garment 100 may comprise a top edge seam 106. At the bottom, the lower body garment 100 may comprise an optional hem 114. Inside, shown as the dashed line, the lower body garment 100 may comprise a control panel 112, which may also be referred to as a waistband. In at least some embodiments, the lower body garment 100 may comprise an outer garment 101 made of a fabric that conceals the control panel 112 such that the control panel 112 is not visible from the outside. For example, the outer garment 101 may be made of ponte and the control panel 112 may be made of any lining fabric.

Figure 1C:
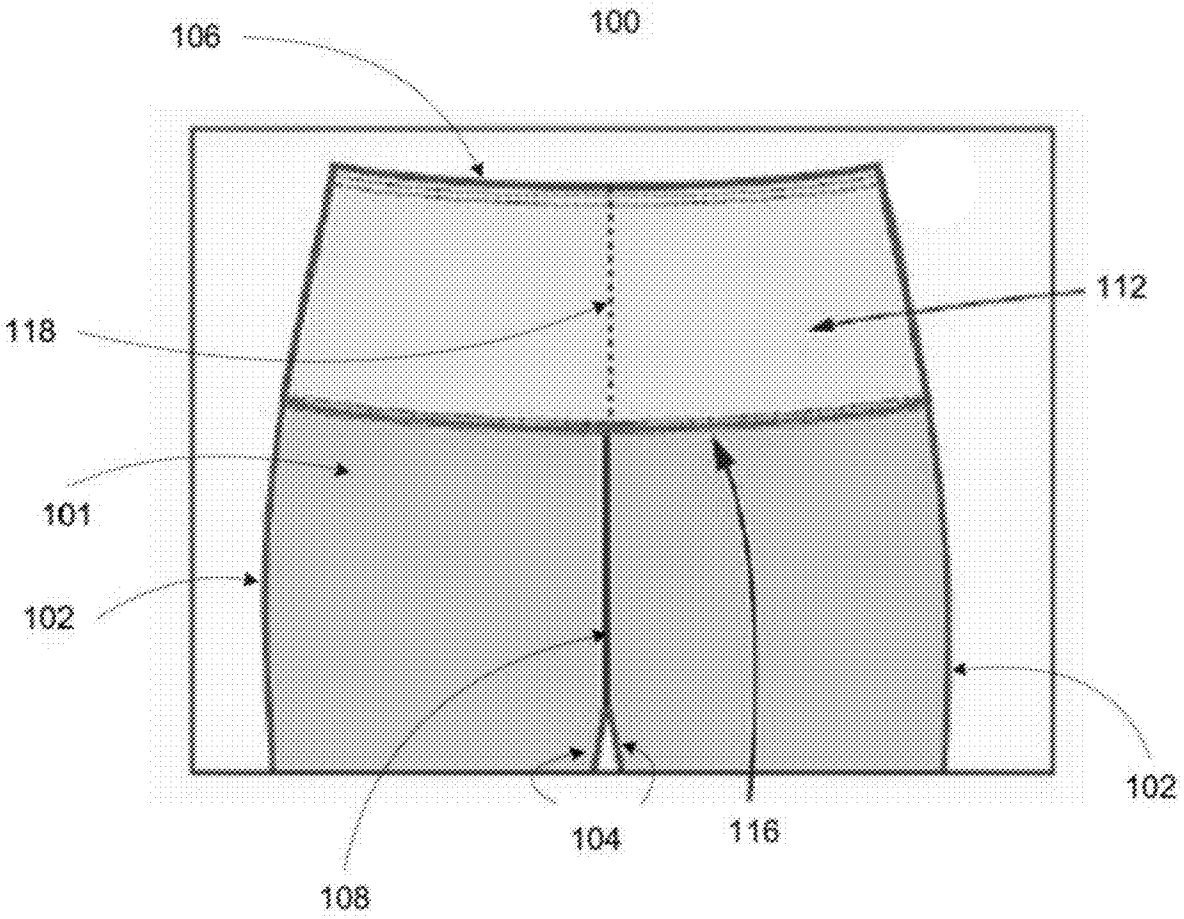
FIG. 1C shows the inside of an exemplary garment according to the present disclosure.

FIG. 1C shows the top portion of the inside of the lower body garment 100. As shown in FIG. 1C, the control panel 112 may have a horizontal rectangular shape that lines the outer garment 101 at both front and back. That is, the control panel 112 may cover the full circumference of an interior waist of the outer garment 101. In some embodiments, the control panel 112 may be anchored to the outer garment 101 at the top edge seam 106 of the outer garment 101. The anchoring may be done by, for example, stitching or glue. In one non-limiting example, the anchoring may be done by ⅛ inch double needle stitch.

Moreover, in addition to anchoring at the top, the control panel 112 may be optionally anchored along one or more vertical seams such as side seams (e.g., outside seam 102), rise seams (e.g., front rise seam 108 and/or the back rise seam 110), or the like. The dotted line 118 may be stitched to the front rise seam 108 (FIG. 1C shows the front inside) or back rise seam 110 (FIG. 1C shows the back inside). The side anchoring may be done by stitching (e.g., chain stitch) or glue. In some embodiments, the side anchoring may cover the full width of the control panel 112, that is, from the top edge to the bottom edge of the control panel 112. In some other embodiments, the side anchoring may cover only a partial length of the full width. For example, if the control panel 112 is 5 inches from top to bottom, the side anchoring may be 5 inches of stitching, or the stitching may just cover the top 3 or 4 inches. It should be noted 5 inches is just an exemplary number, and the control panel 112 may have a width that is reasonable to cover, at least partially, the midsection of a wearer. For example, depending on the size and height of an intended wearer of the lower body garment 100, the control panel 112 may have different widths.

In some embodiments, the bottom edge 116 of the control panel 116 may be floating, that is, not anchored to the outer garment 101, and therefore not observable from the exterior of the garment. For example, the control panel 112 may comprise two layers of lining fabric and the bottom of the two layers may be bound by stitching or glue, but may not be anchored to the outer garment 101. The bonding may be done by stitching (e.g., Merrow or purl stitches) or glue. In one embodiment, the two layers of fabric of the control panel 112 may be tricot and these two layers may be bound together at the bottom edge by 1/16 inch Merrow edge stitch.

Figure 2A:
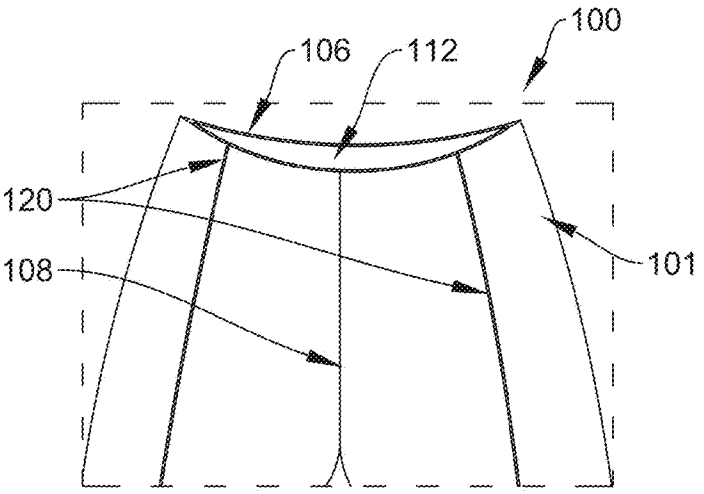
FIGS. 2A-2D show the outside and inside front and back views of an exemplary garment according to the present disclosure.

FIG. 2A shows an outside front view of a top portion of an exemplary lower body garment 100 according to the present disclosure. In this particular embodiment, in addition to the front center rise seam 108, the lower body garment 100 may comprise two vertical design seams 120. It should be noted that the vertical design seams may be optional according to the style of the lower body garment 100, and thus, may not be present in all embodiments of the lower body garment 100. Because the top edge seam 106 in the front is lower than in the back, the top of the control panel 112 may also be visible from the front. Moreover, in this design, the side seams may be invisible from the front.

Figure 2B:
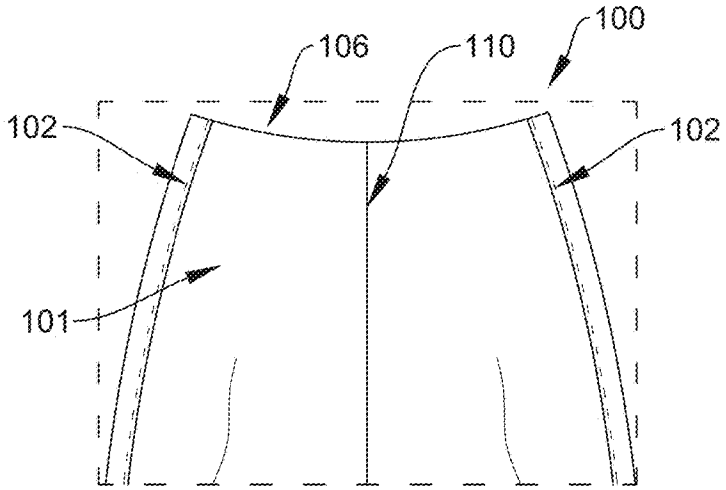

FIG. 2B shows an outside back view of a top portion of an exemplary lower body garment 100 according to the present disclosure. As shown in FIG. 2B, the top edge seam 106, side seams 102, and center back rise seam 110 may be visible from the back.

Figure 2C:
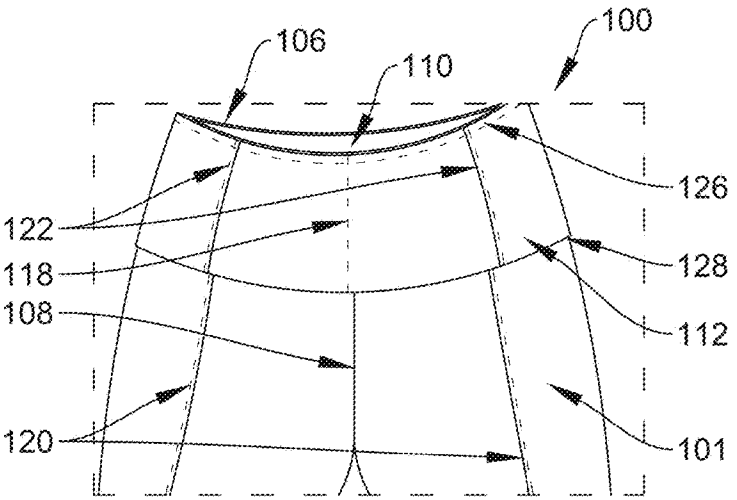
Figure 2D:
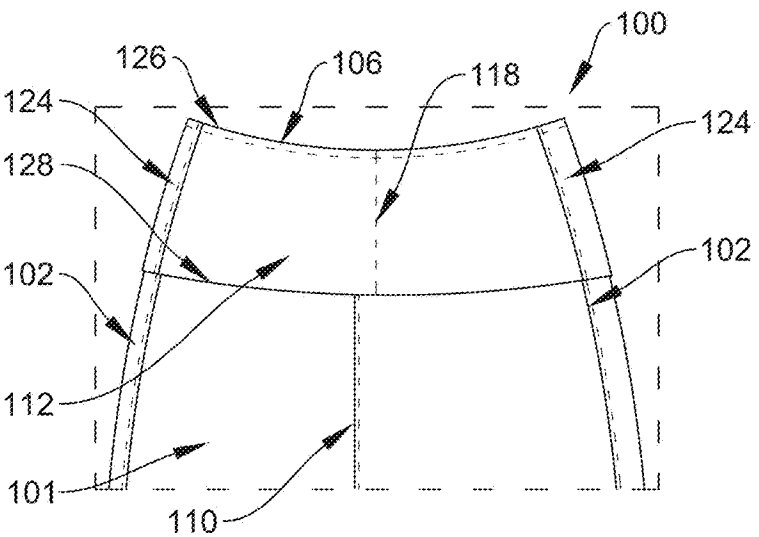

FIG. 2C shows an inside front view and FIG. 2D shows an inside back view of the top portion of an exemplary lower body garment 100 as shown in FIG. 2A. Because the top edge seam 106 in the front is lower than in the back, the top of the back center rise seam 110 may be visible from the front. As shown in FIGS. 2C and 2D, the control panel 112 may cover the full circumference of an interior waist of the outer garment 101. In some embodiments, the control panel 112 may be anchored to the top edge seam 106 by stitching 126. Moreover, in some embodiments, the control panel 112 may be anchored to the side seams 102, rise seams 108 and 110, and vertical design seams 120 by, for example, stitches 124, 118 and 122, respectively.

It should be noted that this additional anchoring may be selective and optional. Some embodiments may have anchoring to some selected vertical seams (e.g., only side seams or only rise seams), some embodiments may have anchoring to all vertical seams, and some embodiments may have no additional anchoring. Also, for those embodiments that may have additional anchoring, some embodiments may have stitching or glue for the full width, and some embodiments may have stitching or glue only for part of the full width (e.g., the top 3 or 4 inches for a 5 inches width).

In one particular embodiment as shown in FIGS. 2A-2D, the control panel 112 may be made of two layers of tricot and bound at the bottom by the stitches 128. The bottom edge of the control panel 112 may be floating. That is, although the two layers of fabric of the control panel 112 may be stitched together, they are not stitched to anything else, and are therefore not seen from the outside of the garment.

Although FIGS. 1A and 1B show the lower body garment 100 in the shape of a pant or legging, the lower body garment 100 may be a skirt in some embodiments, which may have all the vertical seams as shown in FIGS. 2A-2D, or may have some but not all vertical seams as shown in FIGS. 2A-2D.

Figure 3B:
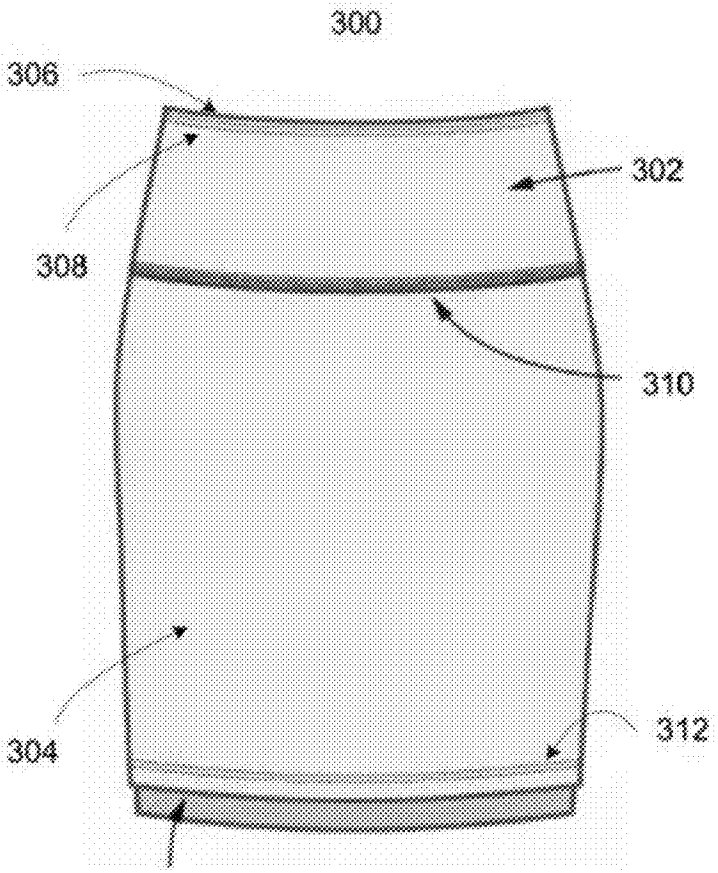
FIGS. 3A and 3B show the outside and inside front of another exemplary garment according to the present disclosure.
Figure 3A:
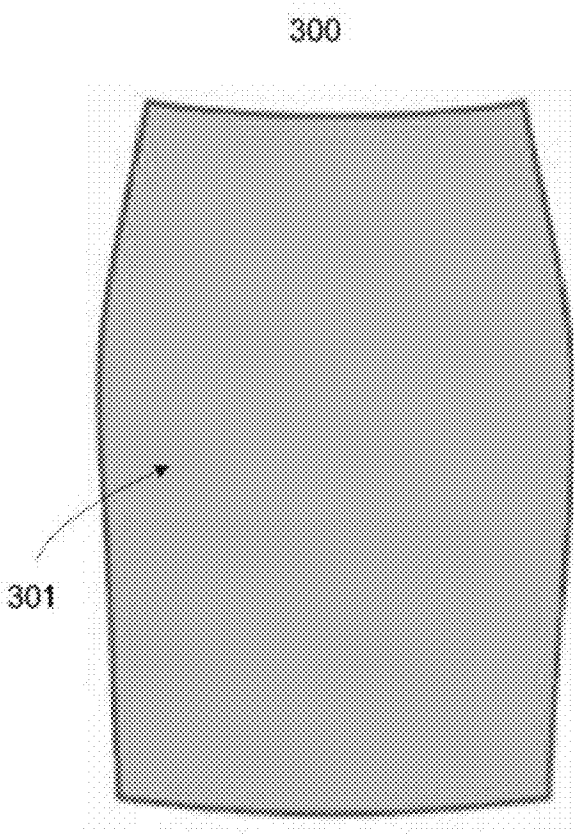

FIGS. 3A and 3B show the outside front and inside front, respectively, of another exemplary lower body garment 300 according to the present disclosure. As shown in FIGS. 3A and 3B, the exemplary lower body garment 300 may be a skirt, and may comprise an outer garment 301 and an interior lining comprising a first area 302 and a second area 304. The first area 302 may be a control panel that covers the full circumference of an interior waist of the outer garment 301. The second area may extend from the bottom edge of the first area to the hem of the outer garment 301, or just above the hem of the outer garment 301. In some embodiments, the first area 302 may comprise two layers of lining fabric, such as tricot, and the second area 304 may comprise one layer of lining fabric, such as tricot. In any event, the outer garment 301 may conceal the first area 302 and second area 304 such that the first and second areas 302 and 304 are not visible from the outside.

In some embodiments, the first area 302 may be a horizontal rectangular shape that lines the outer garment 301 at both front and back and may be referred to as a waistband. As shown in FIG. 3B, the first area 302 may be anchored to the top edge seam 306 by stitching 308 and connected to second area by stitching 310. The stitches 308 may be replaced by glue in some embodiments. In one non-limiting example, the stitches 308 may be ⅛ inch double needle stitch. The stitches 310 may be a horizontal seam that connects interior lining only and is not stitched to the outer garment 301, and is therefore not observable from the exterior of the garment. The stitching 310 may also be replaced by glue in some embodiments. In one non-limiting example, the stitches 310 may be triple needle cover stitch.

The second area 304 may comprise a lining hem 312 at its bottom. In some embodiments, the hem of the outer garment 301 may be a blind hem which is virtually invisible from the outside. As shown in FIG. 3B, the lining hem 312 may block the view of the hem of the outer garment 301 if the second area extends below the hem of the outer garment. For example, if the outer garment has a 1.5 inch hem, and the second area is around 1 inch shorter than the outer garment 301, the hem of the outer garment may be covered by the bottom of the second area 304 in the inside front view. In one non-limiting example, the lining hem 312 may be a ⅝ inch hem.

Figure 3D:
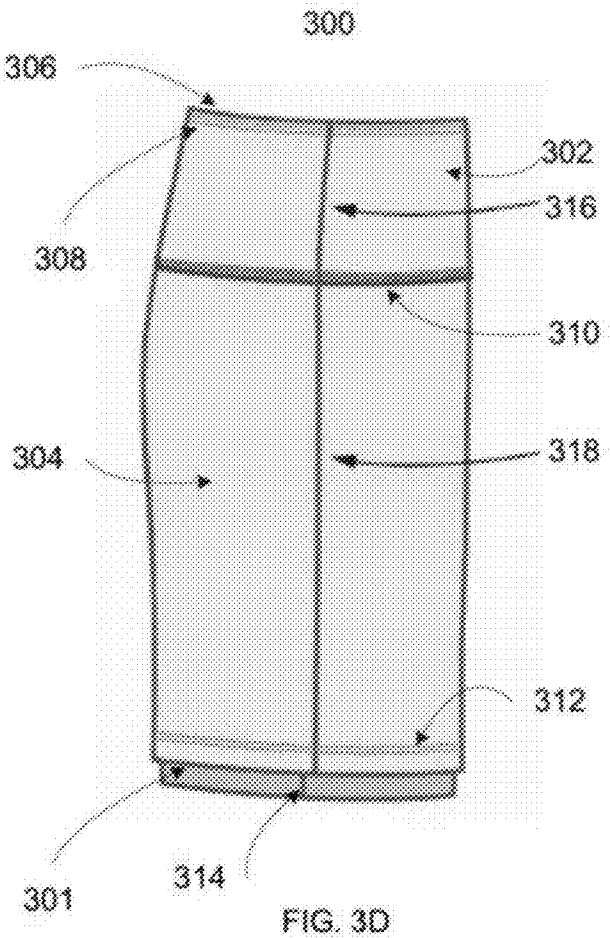
FIGS. 3C and 3D show the outside and inside side of another exemplary garment according to the present disclosure.
Figure 3C:
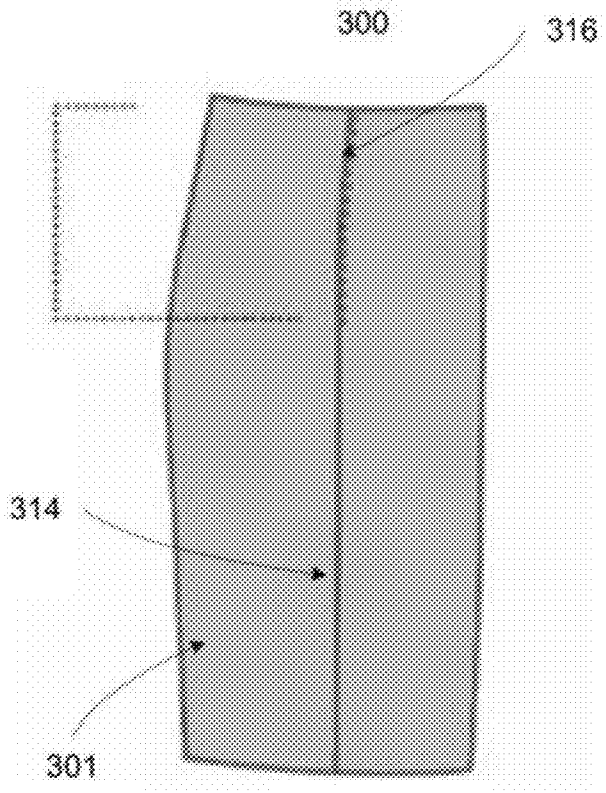

FIGS. 3C and 3D show the outside side portion and inside side portion respectively of the exemplary lower body garment 300 according to the present disclosure. As shown in FIG. 3C, the exemplary lower body garment 300 may comprise a side seam 314. The first area 302 of the interior lining may be anchored to the side seam 314 by the stitching 316, which is shown in dashed lines on FIG. 3C because it may be invisible from an outside view of the side portion. In one non-limiting example, the stitches 316 may be chain stitch. It should be noted that in some embodiments, the stitching 316 may be replaced by glue.

As shown in FIG. 3D, the first area 302 and second area 304 of the interior lining may be connected at the seam 310. In some embodiments, the second area 304 may be anchored to the outer garment 301 by at a seam 318. The anchoring of the second area 304 may be optional, and may be performed using stitching or glue if it is implemented.

Figure 3F:
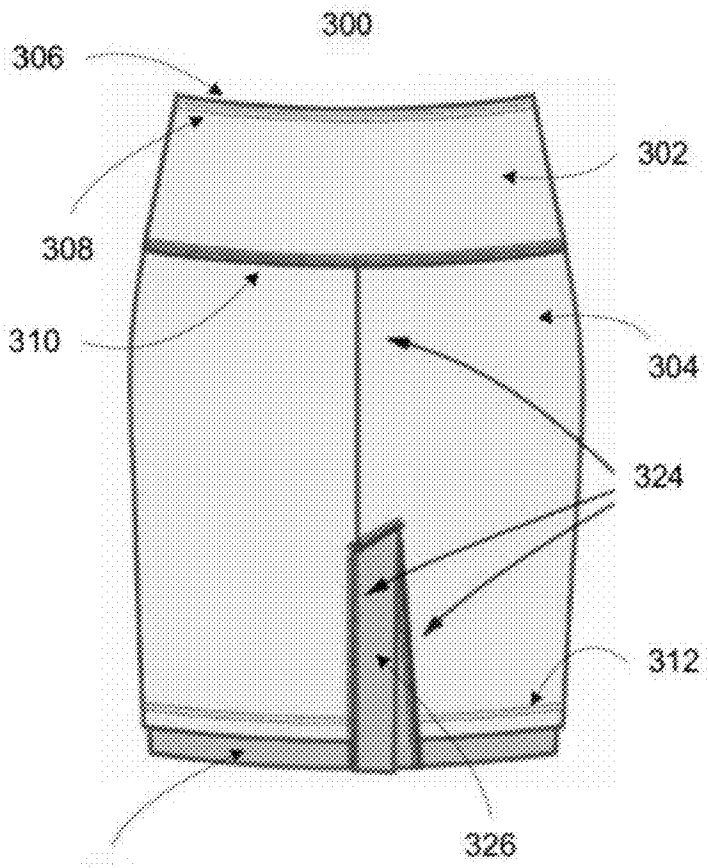
FIGS. 3E and 3F show the outside and inside back of another exemplary garment according to the present disclosure.
Figure 3E:
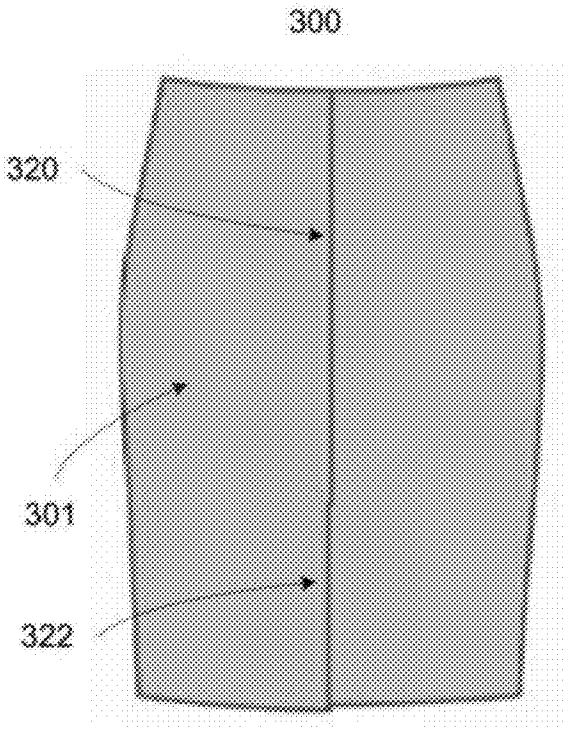

FIGS. 3E and 3F show the outside back and inside back portions respectively of the exemplary lower body garment 300 according to the present disclosure. As shown in FIG. 3E, the exemplary lower body garment 300 may comprise a center back rise seam 320 and a back split 322. As shown in FIG. 3F, in this particular embodiment, the first area 302 of the exemplary lower body garment 300 may float over the center back rise seam 320. That is, the first area 302 of the interior lining is not anchored to the seam 320. Moreover, as shown in FIG. 3F, in this particular embodiment, the second area 304 of the exemplary lower body garment 300 may be stitched into seams 324 at the center back, and at a vent 326 underneath split 322 of the outer garment 301.

In some embodiments, the seams 324 of the second area 304 may be anchored by stitching to the center back rise seam 320 and/or to the vent seams of the outer garment 301. This form of anchoring is optional. Moreover, in some other embodiments, the first area 302 may be anchored to the center back seam 320 by stitching or glue.

Figure 4A:
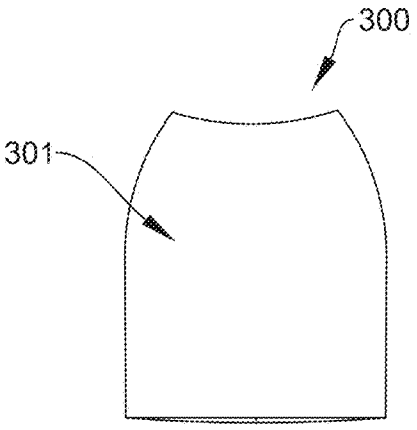
FIGS. 4A-4E show different views of another exemplary garment according to the present disclosure.
Figure 4B:
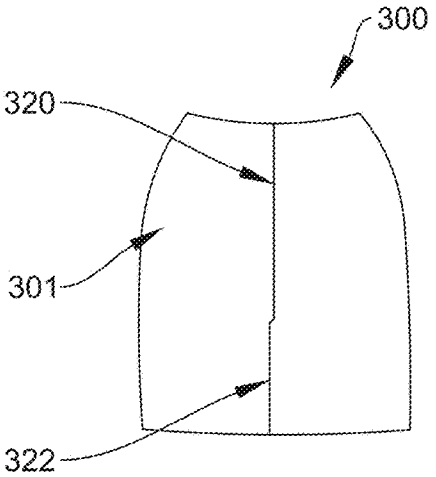

FIGS. 4A-4E show different views of an example of the lower body garment 300 according to the present disclosure. FIG. 4A may be an outside front view of the exemplary lower body garment 300, which may be a skirt and may comprise the outer garment 301. The outer garment 301 may be made of a fabric suitable for outer garments, such as, for example, ponte. FIG. 4B shows an outside back view of the exemplary lower body garment 300, which in the back, may comprise a center back rise seam 320 and split 332. The length of the split 332 may depend on the length of the outer garment 301. In one non-limiting example, the split 332 may be a 6.5 inch split.

Figure 4C:
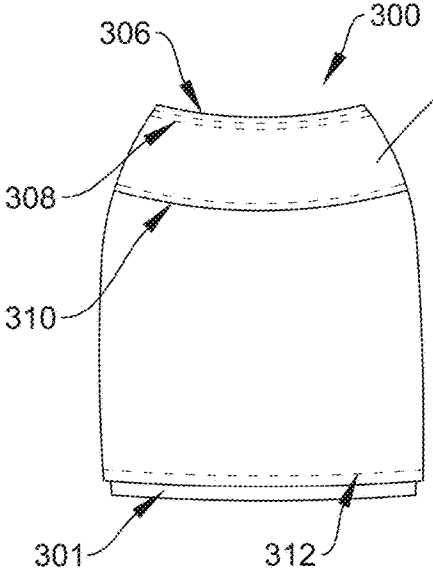
Figure 4D:
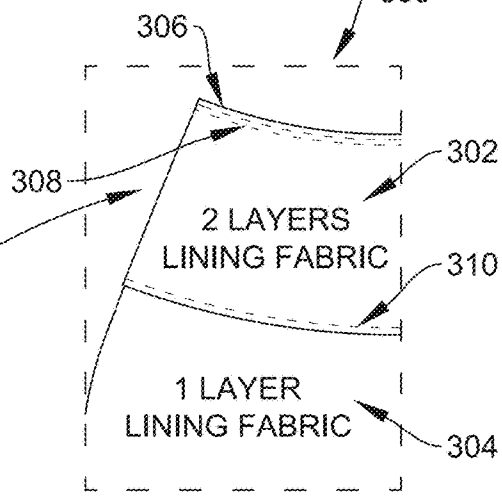

FIG. 4C may be an inside front view of an example of the lower body garment 300, and FIG. 4D may be an enlarged partial view of a top portion of the inside front of the example. As shown in FIGS. 4C and 4D, the first area 302 and the second area 304 of the interior lining may be bound by a seam 310. Moreover, the first area 302 may be anchored to the top edge seam 306 of the outer garment 301 and the second area 304 may be shorter (e.g., by about 1 inch) than the bottom of the outer garment 301. In addition, in some embodiments, the first area 302 may be two layers of lining fabric and the second area 304 may be one layer of lining fabric.

Figure 4E:
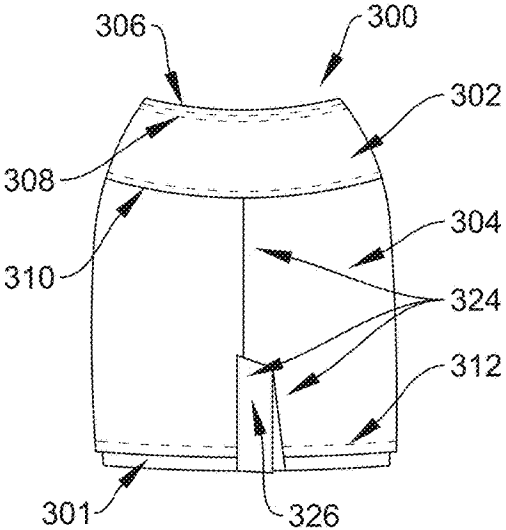

FIG. 4E may be an inside back view of the example of the lower body garment 300. The inside back view may illustrate the vent 326 of the outer garment 301 and seams 324 of the second area 304 at center back and at the vent 326. The seam 324 may be anchored to the center rise seam 320 of the outer garment 301 in some embodiments, and may be floating in some other embodiments. Moreover, the seam 324 may be anchored to seams of the vent 326 in some embodiments, and may be floating in some other embodiments.

Figures 5A, 5B:
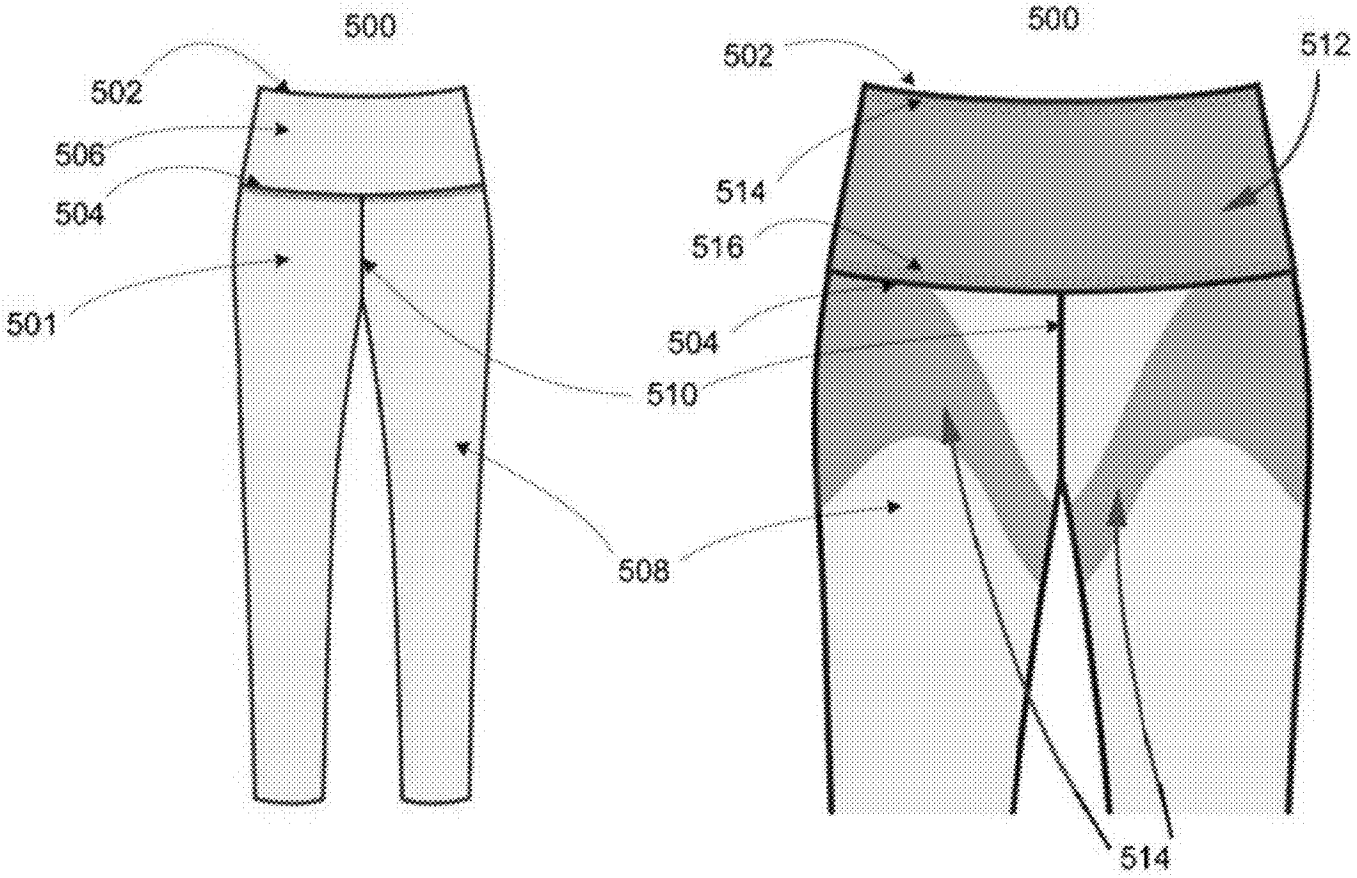
FIGS. 5A and 5B show the outside and inside front of another exemplary garment according to the present disclosure.
Figure 5D:
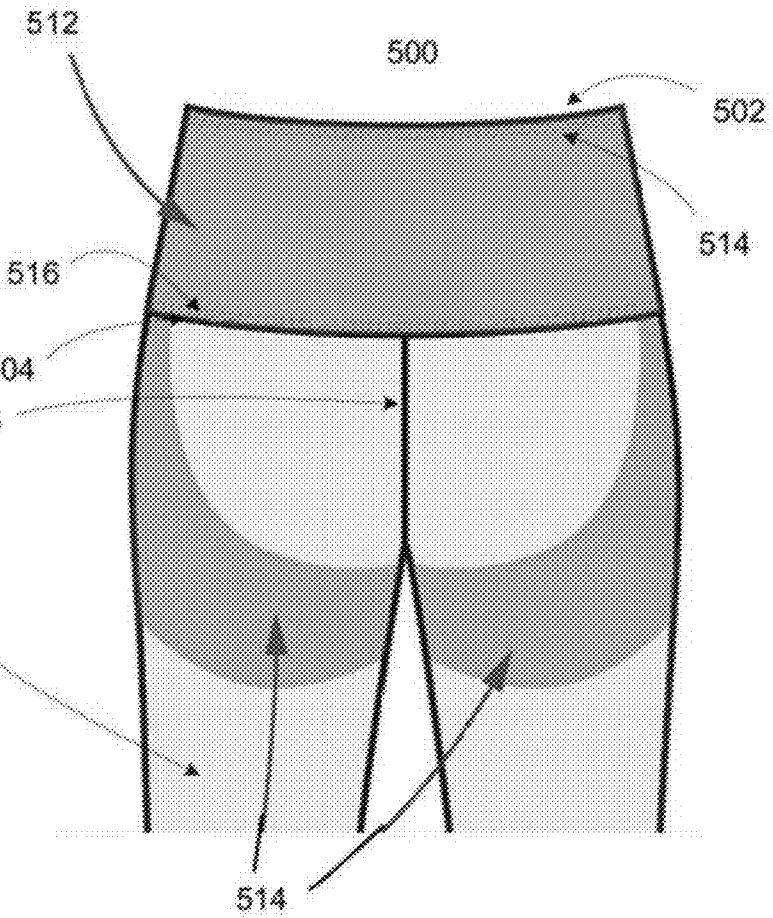
FIGS. 5C and 5D show the outside and inside back of another exemplary garment according to the present disclosure.
Figure 5C:
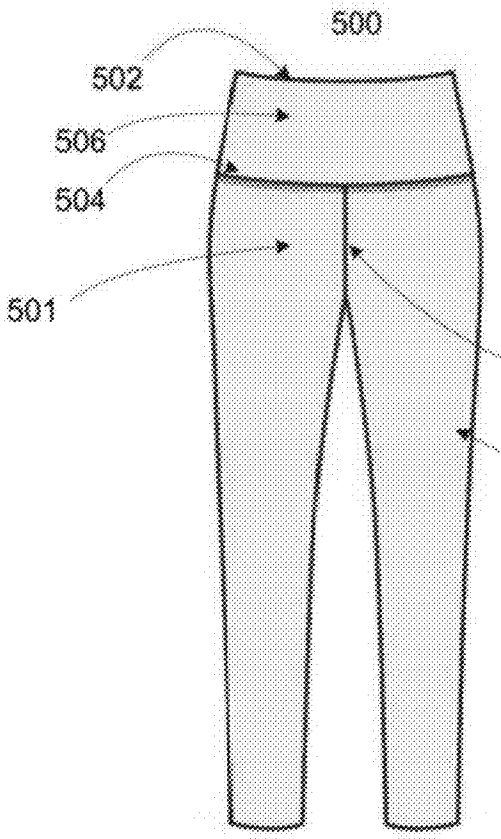

FIGS. 5A and 5B show the outside front and inside front portions, respectively, of another exemplary lower body garment 500 according to the present disclosure, and FIGS. 5C and 5D show the outside back and inside back portions, respectively, of the exemplary lower body garment 500. As shown in FIGS. 5A-5D, the exemplary lower body garment 500 may comprise an outer garment 501. The outer garment 501 may comprise a top edge seam 502 and a lower waist seam 504. The lower waist seam 504 may divide the outer garment 501 into an upper portion 506 and a lower portion 508. The upper portion 506 may be cover the waist of a wearer, and the lower portion 508 may cover at least upper portions of legs of a wearer. The outer garment 501 may have a front center rise seam 510 and a back center rise seam 516 extending from the lower waist seam 504 to the crotch. In some embodiments, the outer garment 501 may be a legging or pant. Moreover, in some embodiments, the outer garment 501 may be high-waisted, so that the top edge seam 502 may be at a wearer's natural waist.

As shown in FIGS. 5B and 5D, the exemplary lower body garment 500 may comprise a first interior area 512 and a second interior area 514 inside the outer garment 501, to provide shaping control. The first interior area 512 may have a horizontal rectangular shape that lines the outer garment 501 between the top edge seam 502 and lower waist seam 504, and such first interior area 512 may cover the full circumference of the interior waist of the outer garment 501. The first interior area 512 may be referred to as a control panel. In at least one embodiment, the first interior area 512 may be anchored to the outer garment 501 at the top edge seam 502 by stitching 514. In some embodiments, the bottom of the first interior area may be floating, that is, the bottom edge of the first interior area 512 may have a seam 516, but the seam 516 is not attached to the lower waist seam 504 of the outer garment 501 or any part of the outer garment 501, and is therefore not visible from the outside of the garment. In some other embodiments, the bottom of the first interior area may be anchored to the outer garment 501 at the lower waist seam 504.

The first interior area 512 may comprise one or more layers of lining fabric. In one non-limiting example, the first interior area 512 may comprise two layers of lining fabric, such as, for example, tricot. In such an example, the two layers of fabric of the first interior area 512 may be bound together at the bottom edge of the fabric (e.g., by the seam 516).

The second interior area 514 may be a lining that begins at the lower waist seam 504 and extends down around the hip, thigh and buttock area. In some embodiments, the second interior area 514 may be attached either by sewing it into the seams of the outer garment 501 (e.g., the rise seams and/or side seams (not shown)), or by bonding or gluing it to the interior face of the outer garment fabric, or by a combination of these attaching methods. In any event, in some embodiments, the outer garment 501 may be made of a fabric that conceals the first and second interior areas such that the first and second interior areas are not visible from the outside.

Figure 6B:
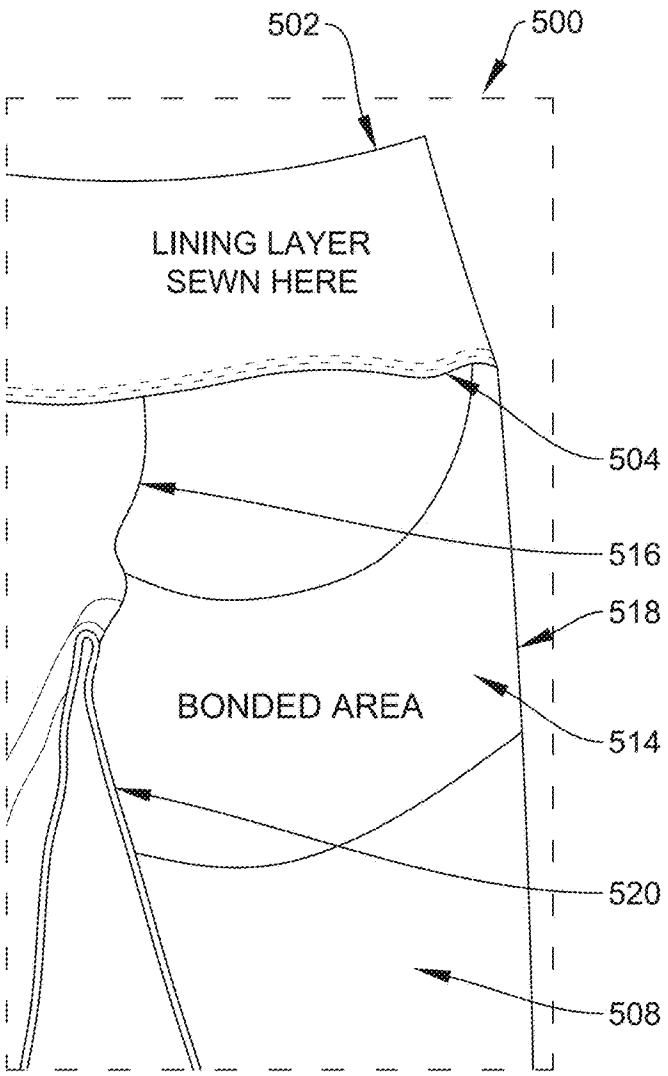
FIGS. 6A-6B show different views of another exemplary garment according to the present disclosure.
Figure 6A:
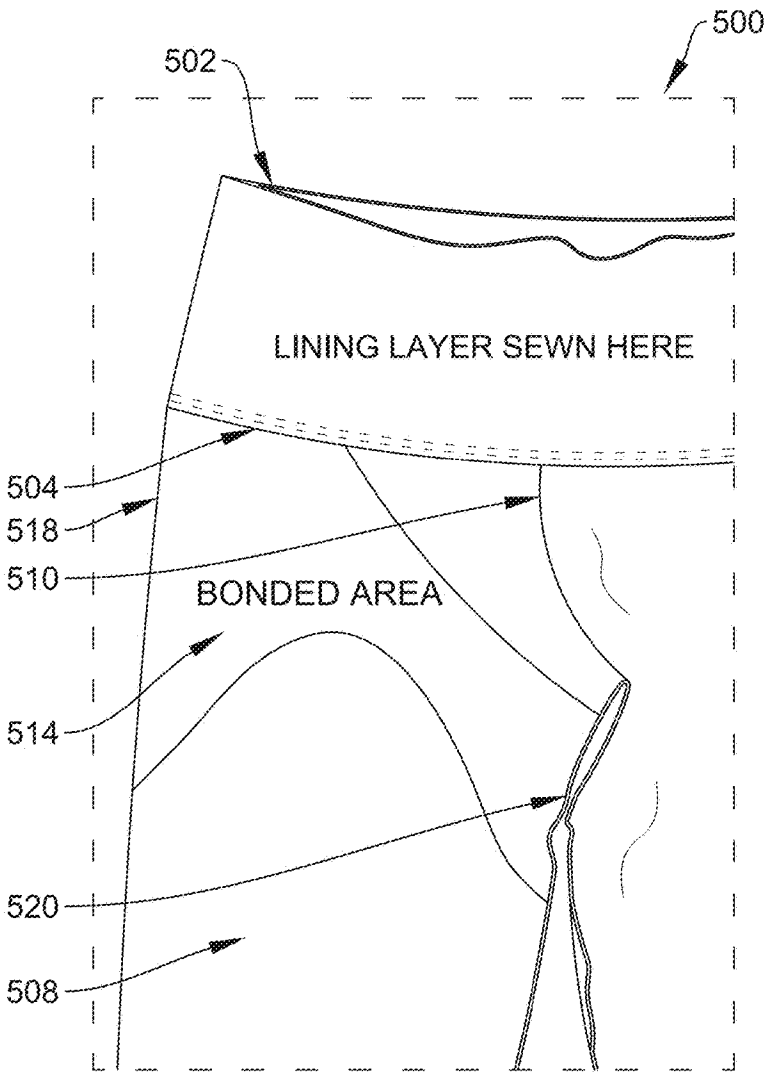

FIG. 6A shows an inside front view of the left side, and FIG. 6B shows an inside back view of the right side of an example of the exemplary lower body garment 500. As indicated in FIGS. 6A and 6B, the first interior area 512 of the interior lining may be sewn between the top edge seam 502 and lower waist seam 504. Moreover, the second interior area 514 may be the bonded between the side seam 518 and inseam 520.

In the front, the second interior area 514 may be curved to cross the thigh area, and attached to the inseam 520 at one distal end and attached to both the outside seam 518 and lower waist seam 504 at another distal end. As shown in FIG. 6A, the front portion of the second interior area 514 may be shaped more narrowly in the middle portion crossing the thigh area than at the two distal ends. In the back portion, the second interior area 514 may be curved under a lower portion of the buttock area. At one distal end, the second interior area 514 may be attached mainly to the inseam 520 and to a lesser extent the rise seam 516. At another distal end, the second interior area 514 may be attached mainly to the outside seam 518 and to a lesser extent the lower waist seam 504. As shown in FIG. 6B, the back portion of the second interior area 514 may be shaped in substantially the same width from one distal end to the other distal end. However, in some embodiments, the distal end attached to the outer seam 518 may be slightly wider than the other distal end attached to the inseam 520.

It should be noted that although FIG. 6A only shows the bonded area on the left side portion and FIG. 6B only shows the bonded area on the right side portion, this is for illustration of the shape of the bonded area. The bonded area may be mirrored on the other side as indicated on the FIGS. 6A and 6B by the phrase "SAME BOTH SIDES."

In the embodiments according to the present disclosure, the outer garment fabric and the lining layer fabric may be any suitable fabrics. Ponte for the outer garment and tricot for the lining layer are exemplary and may be replaced with any other suitable fabrics.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims, in which all terms are meant in their broadest reasonable sense unless otherwise indicated therein.

What is claimed is:

1. A lower body garment that provides shaping benefits, comprising:
   an outer garment having a top edge seam; and
   a control panel;
   wherein the control panel lines a full circumference of an interior waist of the outer garment, the control panel is anchored to the outer garment at the top edge seam of the outer garment, the control panel extends downwardly and hangs freely from the top edge seam, and the control panel is not visible from the outside of the outer garment, and wherein an inner surface of the control panel is configured to lie against the skin of a wearer.

2. The lower body garment of claim 1, wherein the control panel is further anchored to the outer garment along one or more vertical seams.

3. The lower body garment of claim 2, wherein the one or more vertical seams include at least one of a front rise seam, a back rise seam, and a side seam.

4. The lower body garment of claim 1, wherein the control panel is anchored to the outer garment on only a partial length of a full width of the control panel.

5. The lower body garment of claim 1, wherein the control panel is made of a double layer fabric, and a bottom edge of the double layer fabric is bound together.

6. The lower body garment of claim 1, wherein the bottom edge of the control panel is floating.

7. The lower body garment of claim 1, wherein the outer garment is made of ponte.

8. The lower body garment of claim 1, wherein the outer garment is a legging or pant.

9. The lower body garment of claim 8, further comprising:
   a lower waist seam on the outer garment that is located lower than the top edge seam; and
   a second interior lining that begins at the bottom edge of the control panel and extends around at least some of the hip, thigh and buttock area of a wearer.

10. The lower body garment of claim 9, wherein the second interior lining is anchored to the lower waist seam.

11. The lower body garment of claim 9, wherein the control panel is a double layer fabric and a bottom edge of the double layer fabric is bound together, and wherein the second interior lining is a single layer fabric anchored to the bottom edge of the double layer fabric.

12. The lower body garment of claim 1, wherein the outer garment is a skirt.

13. The lower body garment of claim 12, further comprising a second interior lining that is anchored to a bottom edge of the control panel and that is not visible from the outside of the outer garment.

14. The lower body garment of claim 13, wherein the control panel is a double layer fabric, the bottom edge of the double layer fabric is bound together, and the second interior lining is a single layer fabric.

15. A lower body garment that provides shaping benefits, comprising:

an outer garment having a top edge seam and a lower waist seam that is located lower than the top edge seam;

a control panel, wherein the control panel lines the outer garment between the top edge seam and lower waist seam, the control panel is anchored to the outer garment at the top edge seam of the outer garment and at a top edge seam of the control panel, the control panel extends downwardly and hangs freely from the top edge seam of the outer garment, and the control panel is not visible from the outside of the outer garment; and a second interior lining that is anchored to the lower waist seam, that extends around at least some of the hip, thigh and buttock area of a wearer, and that is not visible from the outside of the outer garment.

16. The lower body garment of claim 15, wherein the control panel is a double layer fabric and a bottom edge of the double layer fabric is bound together, and the second interior lining is a single layer fabric.

17. The lower body garment of claim 15, wherein the outer garment is a legging or pant, and wherein the second interior lining forms a band across the thigh area with the band anchored at the seams of the outer garment at both ends of the band, and further forms a band curved under a lower portion of the buttock area.

* * * * *